US007470151B2

(12) United States Patent
Yamaguchi et al.

(10) Patent No.: US 7,470,151 B2
(45) Date of Patent: Dec. 30, 2008

(54) CONNECTING STRUCTURE OF ELECTRIC WIRE AND ELECTRONIC-COMPONENT INCORPORATING UNIT

(75) Inventors: Toru Yamaguchi, Makinohara (JP); Hideki Honma, Ohtaku (JP); Toru Kurosawa, Ohtaku (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/785,841

(22) Filed: Apr. 20, 2007

(65) Prior Publication Data

US 2007/0270019 A1 Nov. 22, 2007

(30) Foreign Application Priority Data

May 19, 2006 (JP) ..... P2006-140369

(51) Int. Cl.
*H01R 9/03* (2006.01)

(52) U.S. Cl. ..... 439/658; 439/76.2; 439/417

(58) Field of Classification Search ..... 439/658, 439/76.2, 620.26, 949, 417
See application file for complete search history.

(56) References Cited

U.S. PATENT DOCUMENTS 5,509,812 A * 4/1996 Comerci et al. ..... 439/76.1
6,447,301 B1 * 9/2002 Hayashi ..... 439/34
6,773,299 B2 * 8/2004 Sawayanagi ..... 439/499
7,252,551 B2 * 8/2007 Ueno et al. ..... 439/620.21
7,297,029 B2 * 11/2007 Ueno et al. ..... 439/620.21
2002/0106929 A1 * 8/2002 Nagai ..... 439/417
2007/0087619 A1 * 4/2007 Nall et al. ..... 439/417

FOREIGN PATENT DOCUMENTS

JP 02-295199 A 12/1990
JP 2006-109587 A 4/2006

* cited by examiner

*Primary Examiner*—Hien Vu
(74) *Attorney, Agent, or Firm*—Sughrue Mion, PLLC

(57) ABSTRACT

A connecting structure includes a unit body including a case having an electronic-component housing concave portion and a fitting-connection concave portion and an electronic component housed in the electronic-component housing concave portion and making a first connecting portion in the fitting-connection concave portion; an electric wire having an electric-wire side terminal in the middle of the electric wire in an electric-wire direction; and a cover member having an electric wire housing portion held on the electric wire so as to overlie an area of the electric-wire side terminal and a cover side fitting part to be fitted in the fitting-connection concave portion. In such a configuration, after the cover member is previously assembled with the electric wire to form a cover-assembled wire, the cover-assembled wire is fit in the fitting-connection concave portion and simultaneously therewith the first connecting portion is connected to the electric wire side terminal.

7 Claims, 12 Drawing Sheets

CONNECTING STRUCTURE OF ELECTRIC WIRE AND ELECTRONIC-COMPONENT INCORPORATING UNIT

BACKGROUND OF THE INVENTION

1. Field of the Invention

This invention relates to a connecting structure of an electric wire and an electronic-component incorporating unit incorporating an electronic component.

2. Related Art

As the case may be, various sensors mounted in e.g. a motor vehicle are supplied, through an electric wire, with noise conducted from a noise source having a high frequency component such as a phone or wiper motor, external noise from a neon sign or induction noise. This leads to a problem of occurrence of malfunction. Conventionally, in order to eliminate these noises, it has been proposed that a noise preventing tool or element incorporating unit as disclosed in the following JP-A-2-295199 and JP-A-2006-109587 is provided in the middle of the electric wire.

The technique disclosed in the following JP-A-2-295199 is the noise preventing tool. This noise preventing tool is provided with an upper resin cover and a lower resin cover which accommodate the middle of the electric wire so as to overlie it. In the lower resin cover, a conductor is formed by plating. At the one end of the conductor, a crimping blade for crimping the middle of the electric wire is provided to protrude from the bottom (inner face) of the lower resin cover. A chip-type capacitor is attached to the middle of the conductor. The chip-type capacitor is fixed by plating the conductor. Namely, the chip-type capacitor can be fixed only by plating. The other end of the conductor is formed to extend to the outer surface of the lower resin cover through a through-hole of the lower resin cover. Specifically, the other end of the conductor is formed on the entire surface of a securing clip provided on the outer surface of the lower resin cover. The noise preventing tool is designed to permit body grounding when the securing clip is secured to a vehicle body.

The technique disclosed in the following JP-A-2006-109587 is a connecting structure of the electric wire and an element incorporating unit. An insulating unit-internal resin cover is provided to partition an internal space between upper and lower covers into an electric wire accommodating space and an element accommodating space. In addition, in the middle of the electric wire, an electric-wire side terminal communicating with the conductor is provided. In this state, if the middle of the electric wire is arranged on the side of the electric wire accommodating space, the electric wire side terminal is inserted into the element accommodating space from the electric wire accommodating space through a terminal inserting hole formed in the unit-internal resin cover and connected to a circuit including the element on the side of the element accommodating space.

Meanwhile, the noise preventing tool according to the related art has a problem that if external force is applied to the electric wire, the crimped portion will come off. Namely, the noise preventing tool has a problem that the portion relative to electric connection is short of strength.

On the other hand, the connecting structure according to the related art gives rise to no problem even if external force is applied to the electric wire, and so can cancel shortage in strength. However, since this connecting structure is a structure in which the covers and electric wire are assembled separately, it has problems of poor operability, and fears of occurrence of catching of the electric wire and occurrence of damaging/curving of the electric-wire side terminal.

SUMMARY OF THE INVENTION

This invention has been accomplished in view of the above circumstance. An object of this invention is to provide a connecting structure of an electric wire and an electronic-component incorporating unit, which can improve the operability and also prevent catching of the electric wire and damaging of an electric wire side terminal.

The first aspect of the invention is a connecting structure of an electric wire and an electronic-component incorporating unit, comprising: a unit body including a case having an electronic-component housing concave portion and a fitting-connection concave portion and an electronic component housed in the electronic-component housing concave portion and making a first connecting portion in the fitting-connection concave portion; an electric wire having an electric-wire side terminal to the middle of the electric wire in an electric-wire direction; and a cover member having an electric wire housing portion held on the electric wire so as to overlie an area of the electric-wire side terminal and a cover side fitting part to be fitted in the fitting-connection concave portion, wherein after the cover member is previously assembled with the electric wire to form a cover-assembled wire, the cover-assembled wire is fit in the fitting-connection concave portion and simultaneously therewith the first connecting portion is connected to the electric wire side terminal.

In accordance with this invention having such a configuration, the electric wire, cover member and case are not separately assembled. Instead of this, the cover-assembled electric wire is previously formed by the electric wire and the cover member, and using this cover-assembled electric wire, fitting and connection are executed in the fitting-connection concave portion within the case. Because of the fitting and connection using the cover-assembled electric wire, assembling can be done with good operability. Further, in accordance with this invention, since the cover member is held to overlie an area of the electric-wire side terminal formed in the electric wire, in the fitting and connection using the cover-assembled electric wire, catching of the electric wire and damaging of the electric-wire side terminal can be prevented.

The second aspect of the invention is a feature that an electric-wire supporting part is formed at a position of each of both sides in an electric-wire axial direction sandwiching the electric-wire side terminal.

In accordance with this invention having such a configuration, since the electric wire is supported, the horizontal state of the electric wire in the area of fitting and connection is kept. Thus, bending of the wire and oblique insertion thereof can be prevented, thereby permitting smooth work. Since the electric wire is supported, catching of the electric wire between the cover member and the fitting-connection concave portion can be also prevented. Further, since the electric wire is supported, even when external force is exerted, any influence on the connection can be prevented. Incidentally, it is assumed that the support in the pressed-in state is included.

The third aspect of the invention is a feature that the cover member has a structure which includes the electric wire housing portion in its inside, a case inserting guide area which is to be inserted into the fitting-connection concave portion for guidance in its outside and the cover side fitting part formed on the case inserting guide area.

In accordance with this invention having such a configuration, the cover-assembled electric wire is guided, during its fitting and connection in the fitting-connection concave portion in such a manner that the case inserting guide area is inserted into the fitting-connection concave portion. In accordance with this invention, because of such a structure of the cover member, smooth work can be done.

The fourth aspect of the invention is that a feature that the case inserting guide area and the electric wire housing portion are caused to have a function of a terminal protecting portion.

In accordance with this invention having such a configuration, the electric-wire side terminal housed in the electric wire housing portion is protected by this electric wire housing portion and the case inserting guide area. In accordance with this invention, damaging of the electric wire side terminal can be prevented.

The fifth aspect of the invention is a feature that the first connecting structure includes spring contacts in elastic contact with the electric-wire side terminal.

In accordance with the invention having such a configuration, in the fitting and connection into the fitting-connection concave portion, the electric-wire side terminal of the cover-assembled electric wire is brought into contact with the spring contacts of the first connecting portion. Thus, the electric connection between the electric wire and the electronic component can be assured. The contact between electric-wire side terminal and the spring contacts can be assured in a warping range of the spring contact at the maximum.

The sixth aspect of the invention, fitting-limiting parts for limiting the fitting of the cover-assembled electric wire are formed in the fitting-connection concave portion or the first connecting portion.

In accordance with the invention having such a configuration, the fitting and connection into the fitting-connection concave portion, if the direction of the cover member of the cover-assembled electric wires is not normal, the fitting into the concave-connection concave portion is limited. Namely, the contact or fitting into the fitting-limiting parts is made impossible. Thus, the electric-wire side terminal will not be forcibly connected to the first connecting portion. As a result, damaging of the electric-wire side terminal and the first connecting portion can be prevented.

The seventh aspect of the invention is a feature that a terminal positioning mechanism for positioning the electric-wire side terminal in the electric-wire housing portion in the electric wire axial direction is formed in the electric wire housing portion and the electric-wire side terminal.

In accordance with the invention having such a configuration, since the position of the electric-wire side terminal is determined, the connection between the electric-wire side terminal and the first connecting portion can be smoothly done. The state after the connection can be stabilized.

The eighth aspect of the invention is a feature that an alignment mechanism is formed in the electric wire housing portion and the electric-wire side terminal, the alignment mechanism permitting movement of electric-wire side terminal in a direction perpendicular to the electric wire axial direction in the electric-wire housing portion, thereby making alignment with the first connecting portion.

In accordance with the invention having such a configuration, the backlash in the direction perpendicular to the electric wire direction is positively formed. Within the range of this backlash, alignment during the connection can be made. This invention is most effective in the fifth aspect of the invention. The connection between the electric-wire side terminal and the first connecting portion can be smoothly done. The state after the connection can be stabilized.

In accordance with the invention, by the fitting and connection using the cover-assembled electric wire, the operability can be improved as compared with the prior art. In addition, the catching of the electric wire and damaging of the electric-wire side terminal can be prevented.

In accordance with the invention, by forming the electric-wire supporting part, the operability can be further improved. The influence from the exterior can be reduced.

In accordance with the invention, by the structure of the cover member, the operability can be further improved.

In accordance with the invention, by the function of the terminal protecting portion, damaging of the electric-wire side terminal can be prevented more effectively.

In accordance with the invention, the structure of the first connecting portion including the spring contacts contributes to assurance of the electric connection between the electric wire and the electronic component.

In accordance with the invention, by forming the fitting limiting parts, the forcible connection of the electric-wire side terminal to the first connecting portion in erroneous assembling can be avoided. Thus, damaging of the electric-wire side terminal and the first connecting portion can be prevented.

In accordance with the invention, the terminal positioning mechanism can further improve the electric connection, and so contributes to connection reliability.

In accordance with the invention, the alignment mechanism can further improve the electric connection by forming an alignment mechanism, and thus contributes to connection reliability.

DETAILED DESCRIPTION OF THE PREFERRED EMBODIMENTS

Figure 1:
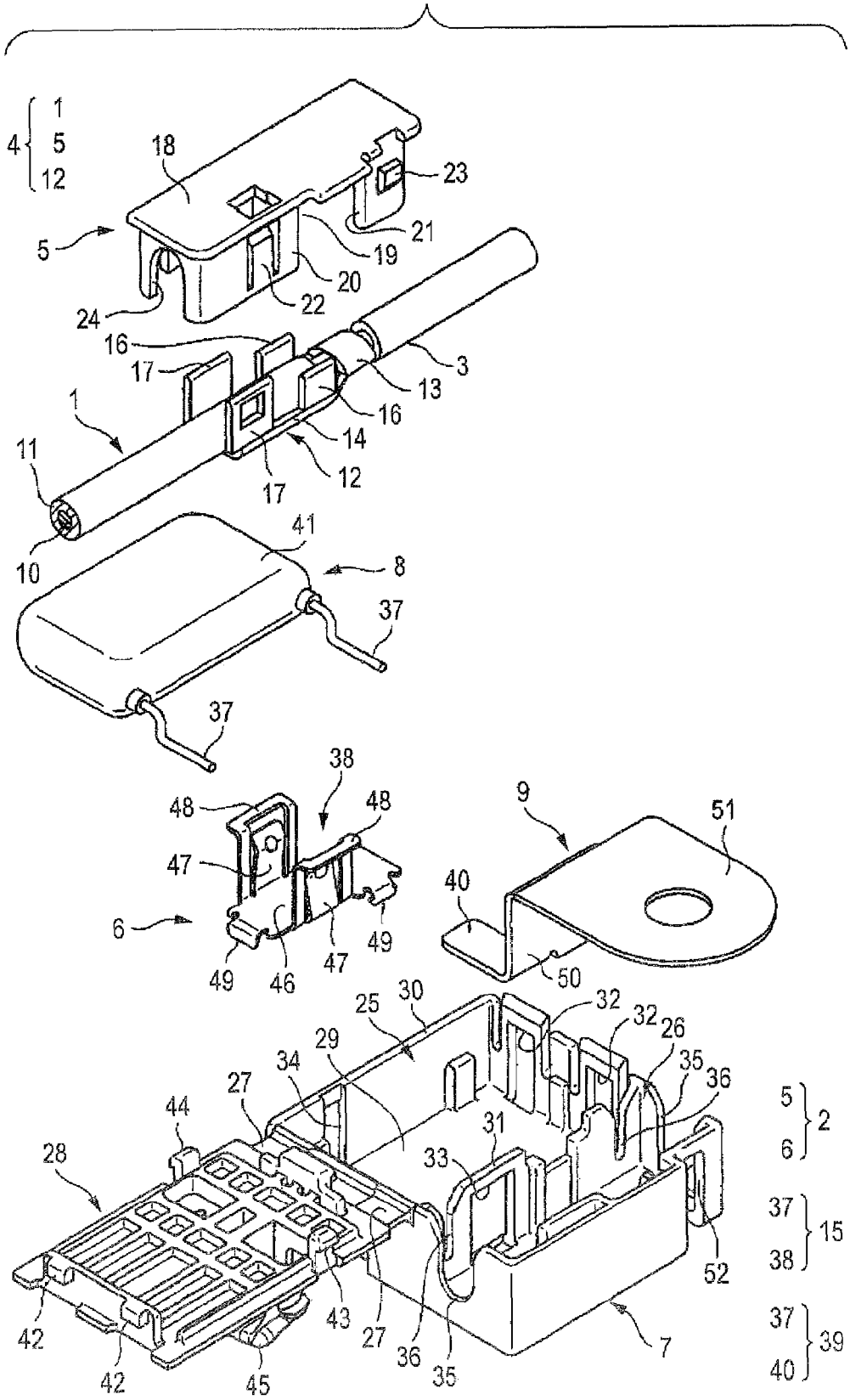
FIG. 1 is an exploded perspective view of an embodiment of the connecting structure between an electric wire and an electronic-component incorporating unit according to this invention.
Figure 2:
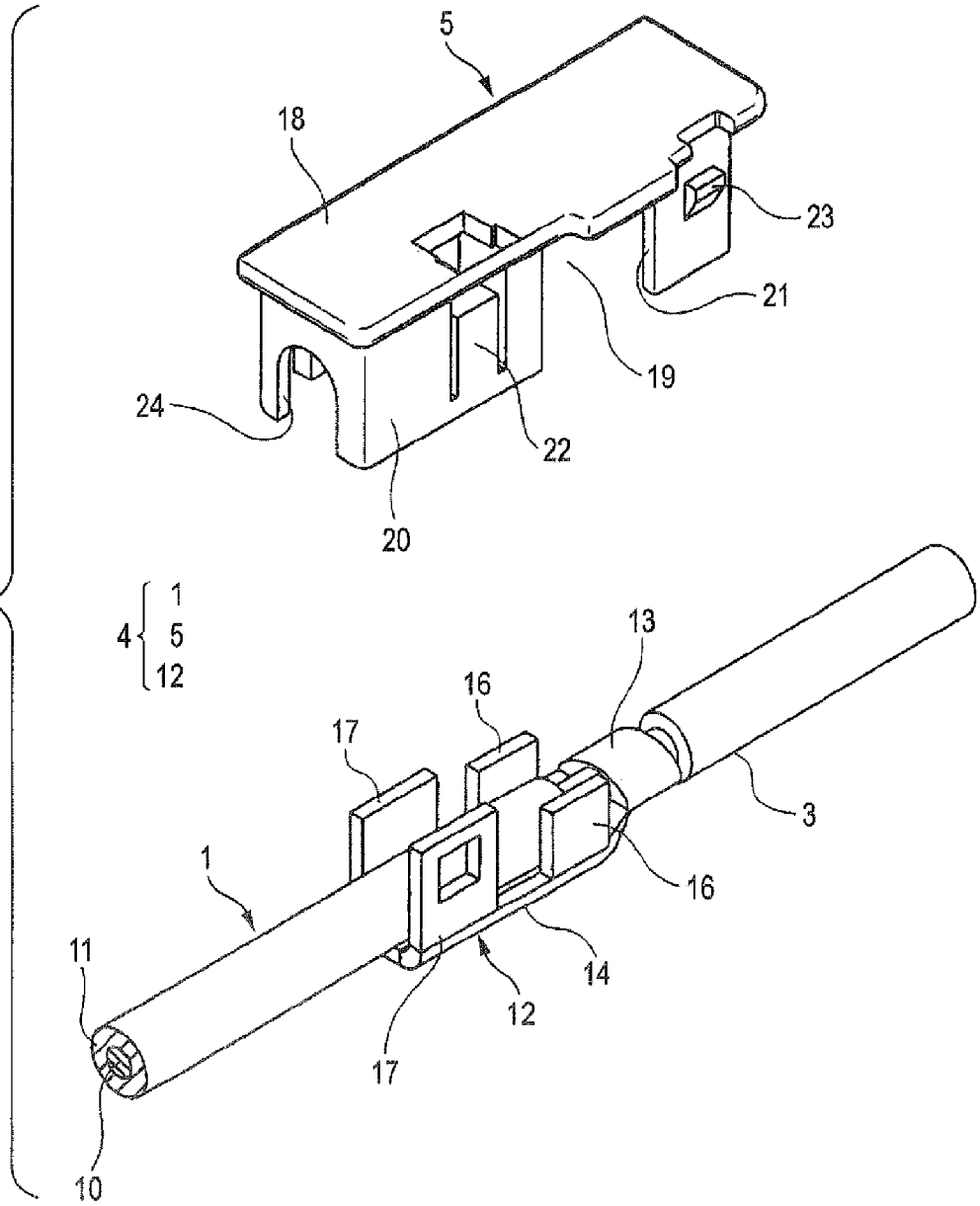
FIG. 2 is an exploded perspective view of a cover-assembled wire.
Figure 3A:
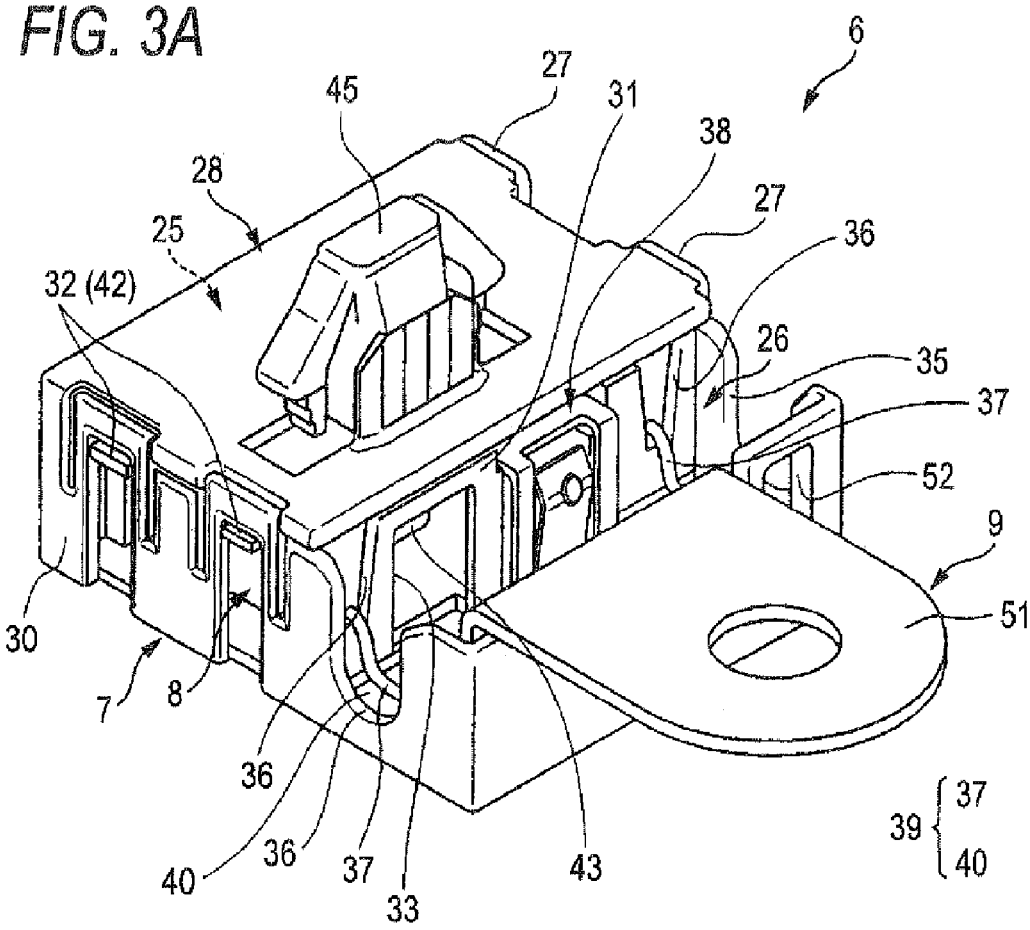
FIG. 3A is a perspective view of a unit body.
Figure 3B:
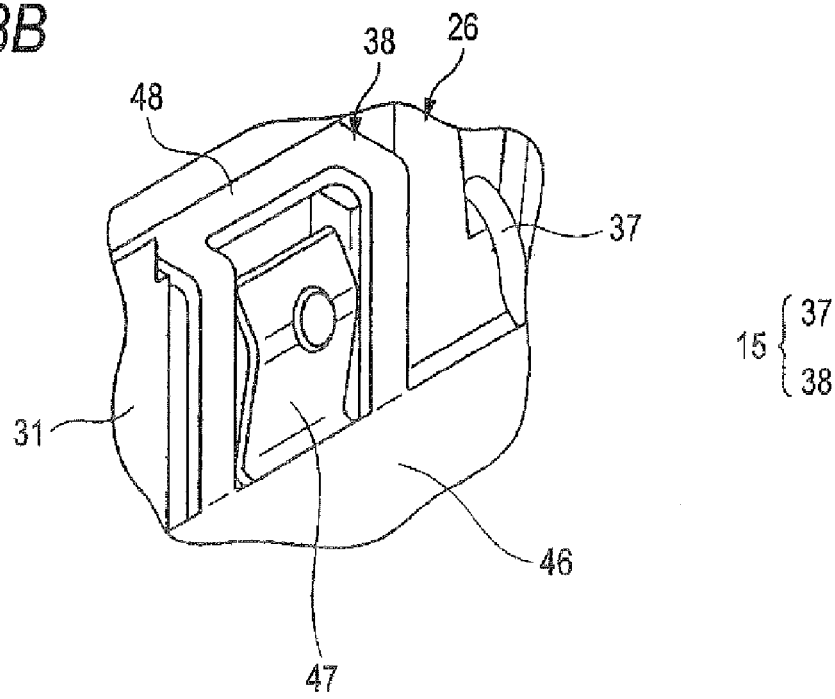
FIG. 3B is an enlarged perspective view of a spring contact in FIG. 3A.
Figure 4:
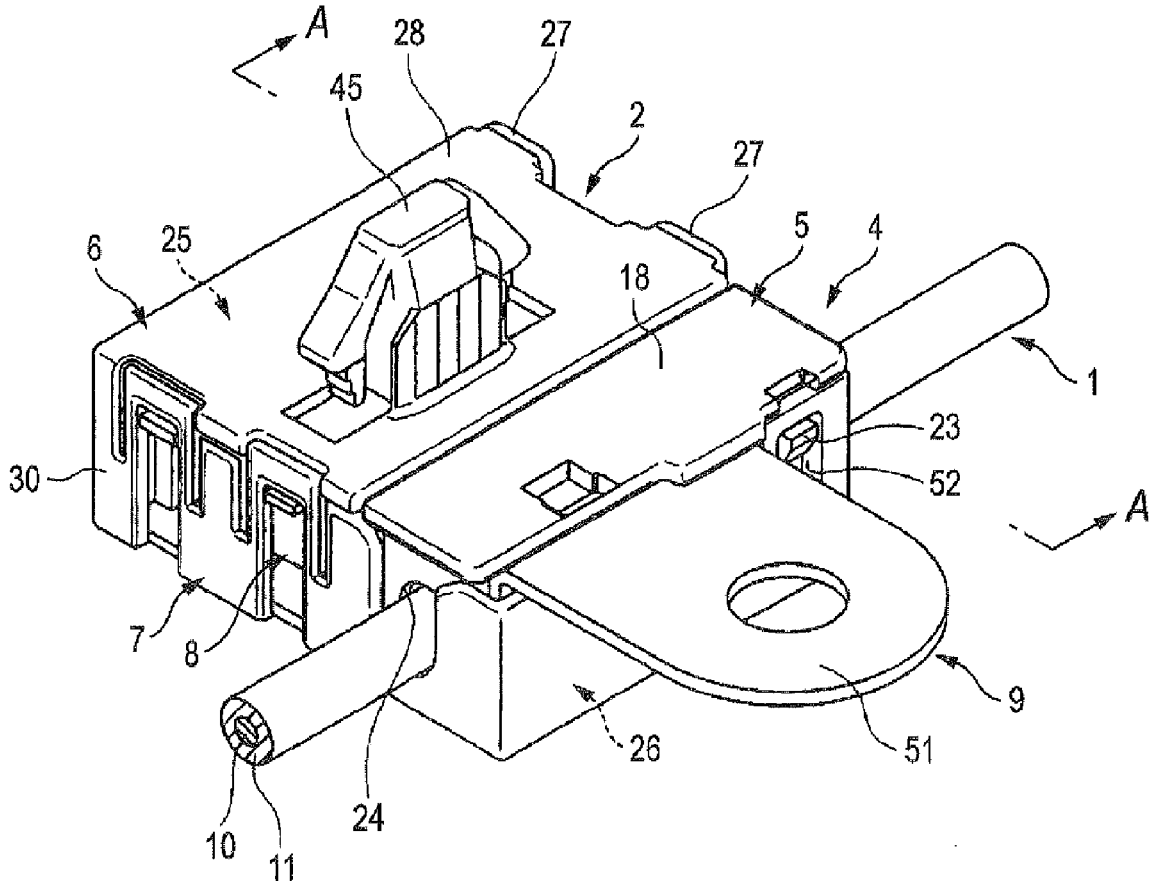
FIG. 4 is a perspective view showing the state where the electronic-component incorporating unit is attached to the middle of the electric wire.
Figure 5:
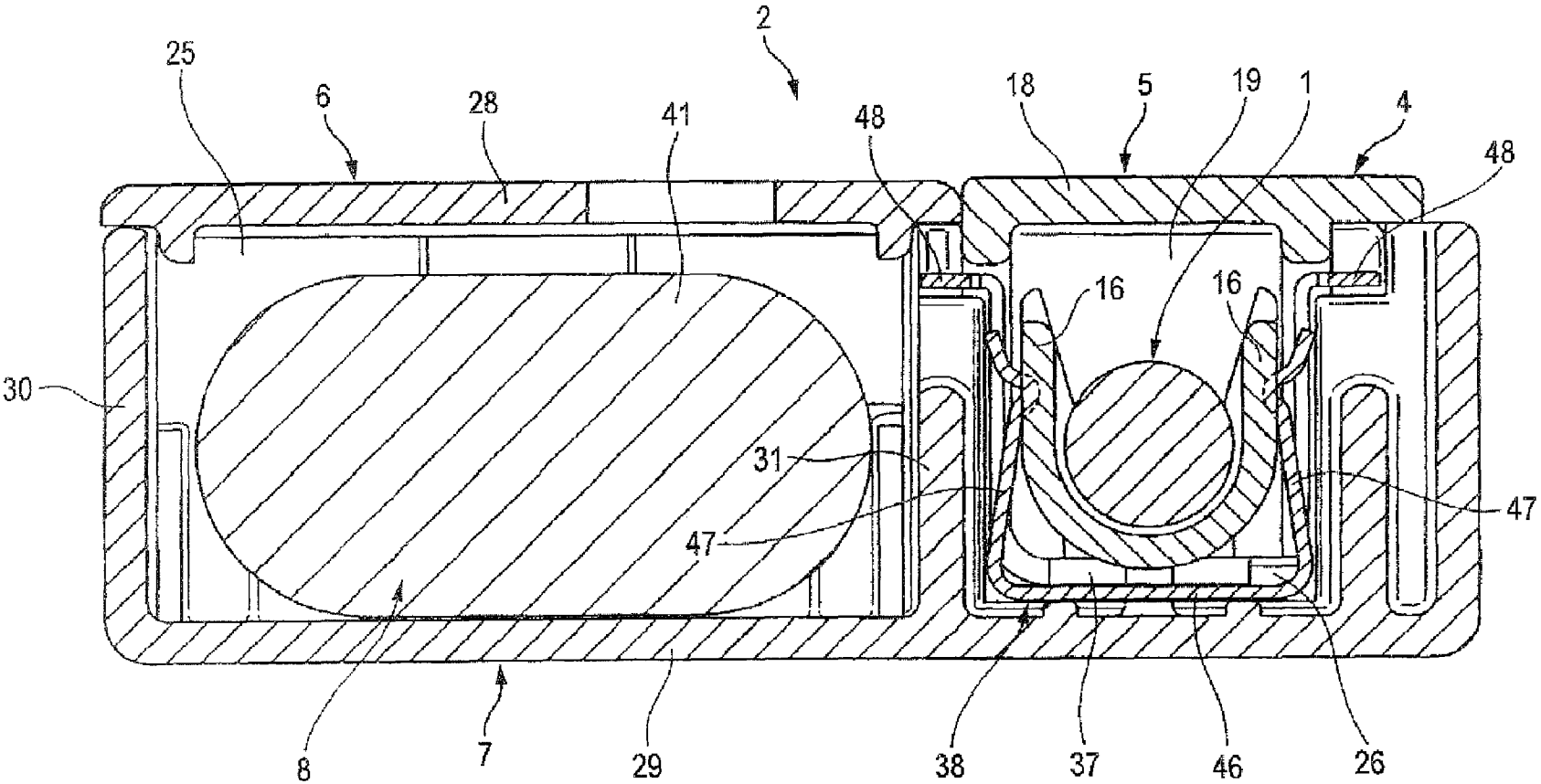
FIG. 5 is a sectional view taken in line A-A in FIG. 4.
Figure 6:
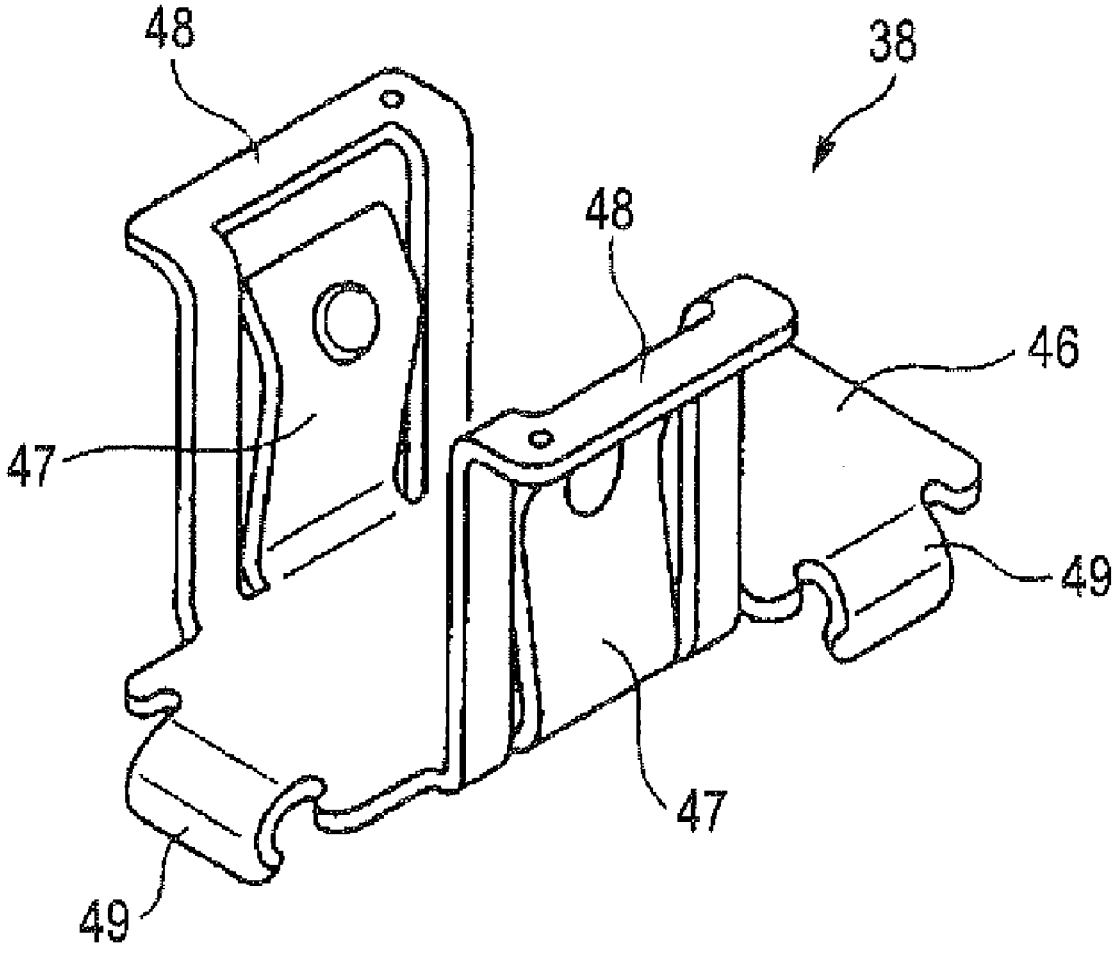
FIG. 6 is a perspective view of a relay terminal constituting a first connecting portion.
Figure 7:
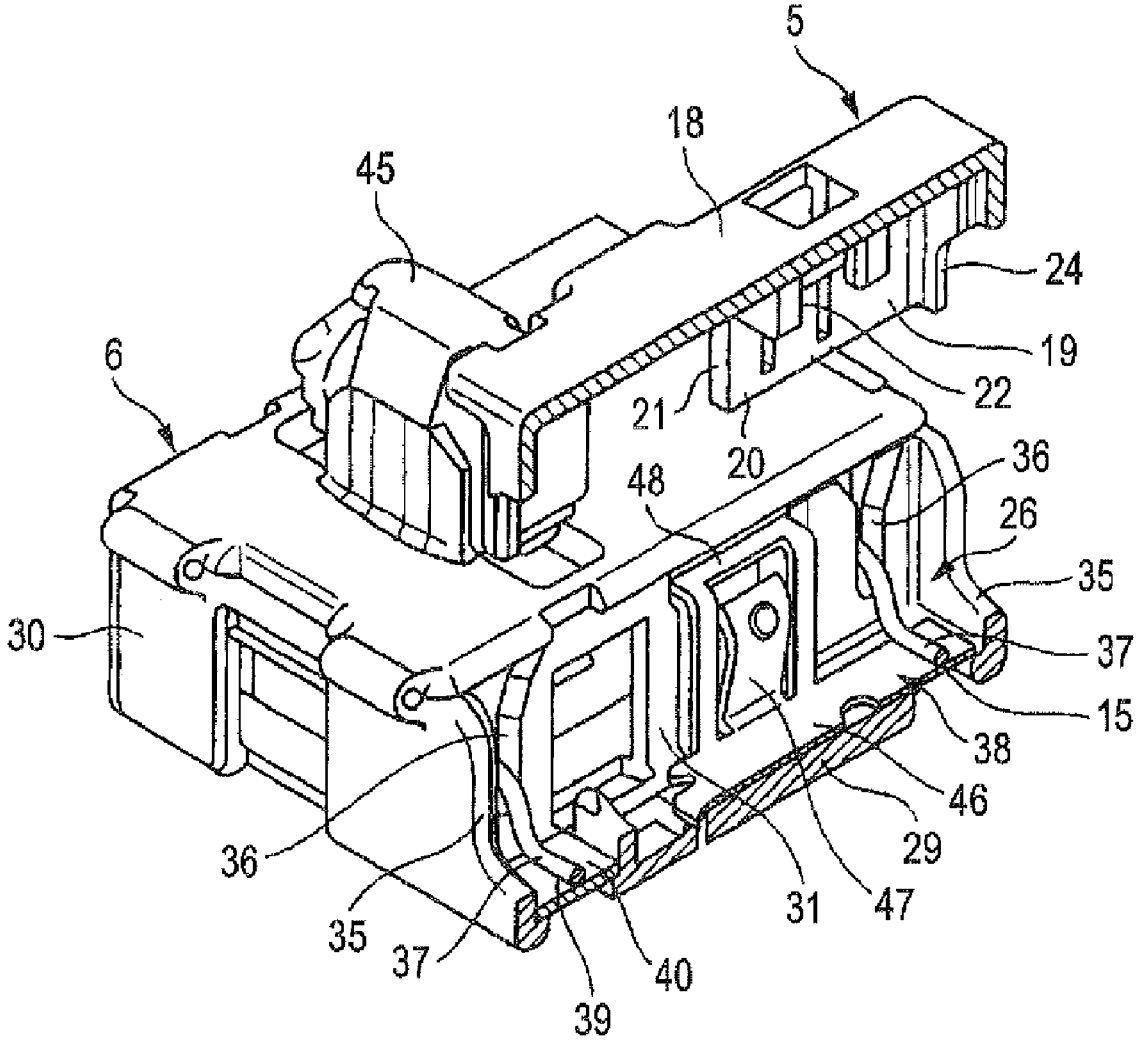
FIG. 7 is a view showing the state where a cover member is to be fit in a direction which is not normal.
Figure 8:
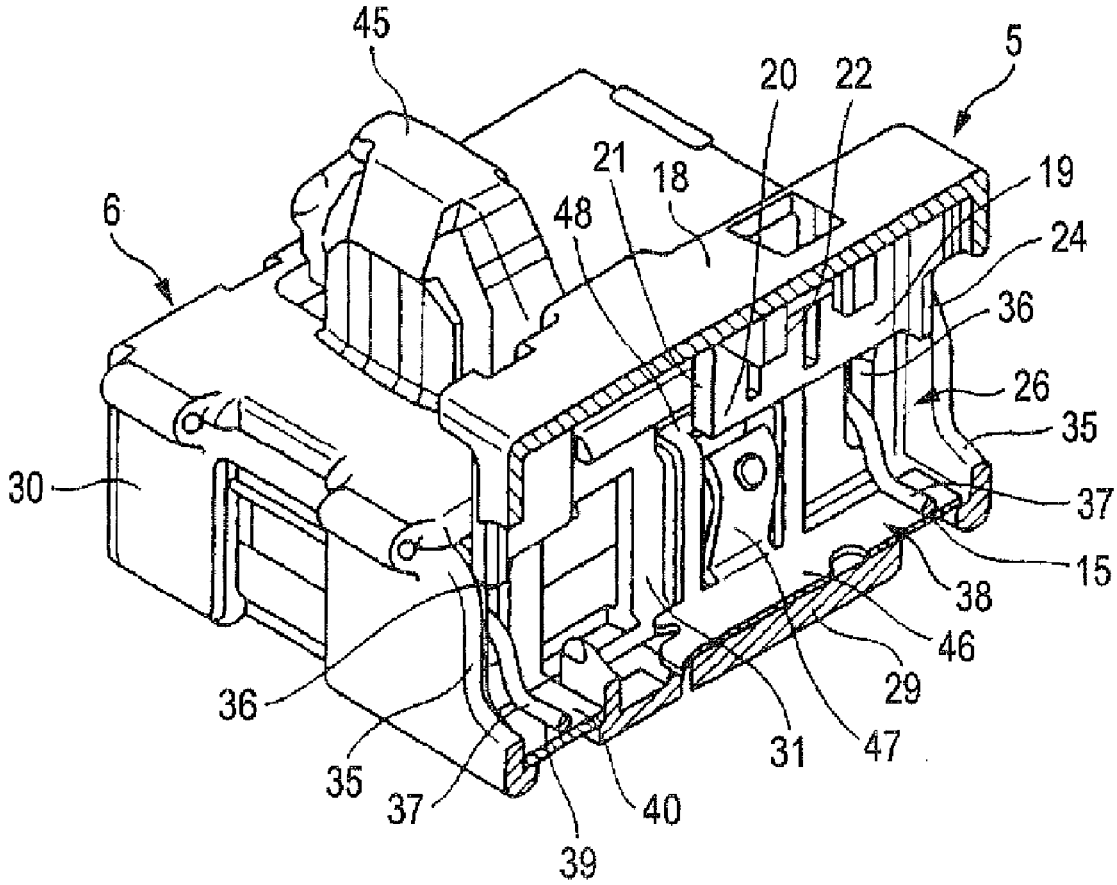
FIG. 8 is a view showing the state where the side wall of the cover member is brought into contact with a fitting-limiting part from the state in FIG. 7, thereby limiting the fitting.

Now referring to the drawings, an explanation will be given of the invention. FIG. 1 is an exploded perspective view of an embodiment of the connecting structure between an electric wire and an electronic-component incorporating unit according to this invention. FIG. 2 is an exploded perspective view of a cover-assembled wire. FIG. 3A is a perspective view of a unit body. FIG. 3B is an enlarged perspective view of a spring contact in FIG. 3A. FIG. 4 is a perspective view showing the state where the electronic-component incorporating unit is attached to the middle of the electric wire. FIG. 5 is a sectional view taken in line A-A in FIG. 4. FIG. 6 is a perspective view of a relay terminal constituting a first connecting portion. FIG. 7 is a view showing the state where a cover member is to be fit in a direction which is not normal. FIG. 8 is a view showing the state where the side wall of the cover member is brought into contact with fitting-limiting parts from the state in FIG. 7, thereby limiting the fitting.

In FIG. 1, reference numeral 1 denotes a known electric wire. Reference numeral 2 denotes an electronic-component incorporating unit which will be attached to the middle of the electric wire 1 (an intermediate portion 3). The electronic-component incorporating unit 2 includes a cover member 5 which is previously attached to the intermediate portion 3 of the electric wire 1 to constitute a cover-assembled electric wire 4 and a unit body 6 making an electric connection by fitting the cover-assembled electric wire 4. The unit body 6 includes a case 7, an electronic component 8 and a grounding terminal 9. In the following, referring to FIGS. 1 to 6, an explanation will be given of the individual structures (the assembling operation will be explained after the individual structures have been explained).

The electronic-component incorporating unit 2, as understood from the description made later, is designed to serve as a noise filter in this embodiment (although not limited).

Although not particularly limited in the explanation of this embodiment, the electric wire 1 is arranged in a vehicle such as an automobile (applicable to the other object than the vehicle). The electronic-component incorporating unit 2 is secured to a vehicle body.

The electric wire 1 is one of a plurality of electric wires constituting a wire harness, or a single electric wire. The electric wire 1 includes a conductor 10 and an insulating cover portion 11 which covers the conductor 10. An electric-wire side terminal 12 is electrically connected to the intermediate portion 3 of the electric wire 1. Specifically, the electric-wire side terminal 12 is connected to the conductor 10 which is naked by removing the cover portion 11 in a predetermined range in the intermediate portion 3 of the electric wire 1.

The electric-wire side terminal 12 is formed in such a shape as shown by working a metallic plate having conductivity. The electric-wire side terminal 12 includes an electric-wire connecting part 13 directly connected to the conductor 10, a substrate part 14 continuous to the electric-wire connecting part 13, a pair of electric contacts 16, 16 formed upright integrally to the sides of the substrate part 14 and connected to a first connecting portion 15 described later of the electric-component incorporating unit 2, and a pair of secured parts 17, 17 likewise formed upright integrally to the sides of the substrate part 14 and secured to a cover member 5.

The pair of electric contacts 16, 16 are tab-like portions and arranged so that they are in parallel on both sides in a direction perpendicular to the electric wire axis of the electric wire 1. The pair of electric contacts 16, 16 are located between the electric wire connecting part 13 and the pair of secured parts 17, 17. The pair of secured parts 17, 17 are tab-like portions like the pair of electric contacts 16, 16 and arranged so that they are in parallel on both sides in the direction perpendicular to the electric wire axis of the electric wire 1. In this embodiment, only one of such pair of secured parts 17, 17 has a square through-hole formed for securing. The pair of electric contact parts 16, 16 and pair of secured parts 17, 17 are protruded so as to agree with the direction of attaching the cover member 5.

The cover member 5 is a member made of synthetic resin having insulation, and is formed to be held on the electric wire 1 in an area of the electric-wire side terminal 12. The cover member 5 has a roof wall 18 and a side wall formed at the edges of the roof wall 18. As regards the side wall, its inside constitutes an electric wire housing portion 19. The outside of the side wall constitutes a case inserting guide area 20 which is to be inserted into the case 7 for guidance.

Further, the side wall has notches 21, 21 at the positions corresponding to the pair of electric contact parts 16, 16 of the electric-wire side terminal 12. The side wall has an arm-like securing projection 22 having flexibility at the position corresponding to the one secured part 17 of the electric-wire side terminal 12. Further, the side wall has a nearly projective cover-side fitting part 23 to be fit in the case 7.

Reference numerals 24, 24 (only one is denoted) denote electric wire supporting parts formed on the sidewall. The electric wire supporting parts 24, 24 are located so as to correspond to the positions of both sides in the electric wire direction which sandwich the electric-wire side terminal 12. The electric wire supporting parts 24, 24 are formed to be notched in a U-shape. The electric wire supporting parts 24, 24 are formed so that they can support the electric wire 1 in its press-fitted state (The supported structure of the electric wire 1 is preferably a press-fitting structure, but may be any other structure as long as the horizontal state of the electric wire 1 is kept when the cover member 5 is attached. This structure preferably contributes to prevention of bending or oblique-insertion of the electric wire 1).

The case 7 of the unit body 6 is a member made of synthetic resin having insulation. The case 7 includes an electronic component housing concave portion 25, a fitting-connection concave portion 26 adjacent thereto and a housing concave cover 28 continuing to the opening edge of the electronic component housing concave portion 25 through a hinge 27. The electronic component housing concave portion 25 and fitting-connection concave portion 26 are surrounded by a bottom wall 29, a side wall 30 formed at the edge of the bottom wall 29 and a partition wall 31. The electronic component housing concave portion 25 is formed as a concave shape portion for housing the electronic component 8. The fitting-connection concave portion 26 is formed as a portion where the cover-assembled electric wire 4 is fit to make an electric connection. The electronic-component housing concave portion 25 and fitting-connection concave portion 26 are separated by the partition wall 31.

The side wall 30 and partition wall 31 have a plurality of securing parts 32, 33, 34. The side wall 30 has also electric wire supporting parts 35, 35. The securing parts 32, 33, 34 are formed to secure the housing concave cover 28. The securing parts 32, 33, 34 are formed in the area of the electronic component housing concave portion 25. The securing parts 32, 33, 34 are formed to pass through the side wall 30 and partition wall 31.

The electric wire supporting parts 35, 35 are formed in the area of the fitting-connection concave portion 26. The electric wire supporting parts 35, 35 are formed to be notched in a U-shape. The electric wire supporting parts 35, 35 are formed so that they can support the electric wire 1 inserted in fitting the cover-assembled electric wire 4.

The partition wall 31 has electronic-component-leg supporting parts 36, 36. The electronic-component-leg supporting parts 36, 36 are formed to support the legs 37, 37 extending to the fitting-connection concave portion 26 of the electronic component 8 housed in the electronic component housing concave portion 25. The electronic component leg supporting parts 36, 36 are formed to be notched in a U-shape.

The fitting-connection concave portion 26, although not denoted by reference numerals, has a part fixed to a relay terminal 38 constituting a first connecting portion 15, a part fixed to the grounding terminal 9 and a part for forming a second connecting portion 39. The first connecting portion 15 consists of the relay terminal 38 and the one leg 37 which is conductive in contact therewith. The second connecting part 39 consists of a connecting tab 40 of the grounding terminal 9 and the other leg 37. The first connecting portion 15 and second connecting portion 39 will be described later.

The housing concave cover 28 is formed in a shape overlying the opening of the electronic component housing concave portion 25. The housing concave cover 28 is formed in a shape which presses the body 41 of the electronic component 8 after housed in the electronic component housing concave portion 25. The housing concave cover 28 has securing projections 42, 43, 44 which are caught in the securing parts 32, 33, 34. Reference numeral 45 in the housing concave cover 28 denotes a securing part for the above vehicle body (its shape is exemplary).

Incidentally, in order to show the secured state of the securing projections 42, FIGS. 3 and 4 are illustrated with the attaching position of the housing concave cover 28 being different from that in FIG. 1. Further, the direction of the securing part 45 is also different from that in FIG. 1.

The relay terminal 38 constituting the first connecting portion 15 is formed in a shape as shown by working a metallic sheet having conductivity. The relay terminal 38 has a bus-bar like fixed substrate part 46 and a pair of spring contacts 47, 47 formed upright integrally to the sides of the fixed substrate part 46 and brought into contact with the electric contacts 16, 16 of the electric wire side terminal 12. Further, in this embodiment, the relay terminal 38 has fitting-limiting parts 48, 48 which limits the fitting of the cover-assembled electric wire 4 according to the direction of the cover member 5 and also serves as a protecting portion for the spring contacts 47, 47.

The fixed substrate part 46 is formed to be fixedly placed on the bottom wall 29 of the case 7 in the fitting-connection concave portion 26. The fixed substrate part 46 has a plurality of fixing lugs 49 which are caught on the bottom wall 29 of the case 7 to prevent the relay terminal 38 from coming off from the fitting-connection concave portion 26. The spring contacts 47, 47 are formed to be brought into elastic contact with the electric-wire side terminal 12. In this embodiment, the spring contacts 47, 47 are formed as V-shape arms which become convex in a direction in which they approach each other. The fitting-limiting parts 48, 48 are formed in gate shapes which encircle the spring contacts 47, 47, respectively. The tip of each of the fitting-limiting parts 48, 48 is formed in a flexed shape so as to be caught in the opening edge of the fitting-connection concave portion 26. Incidentally, the manner of forming the first connecting portion 15 will be explained later.

The grounding terminal 9 is formed in a shape as shown by working a metallic plate having conductivity. The grounding terminal 9 is formed to include a part existing in the fitting-connection concave portion 26 and a part extending externally of the case 7 through the opening edge of the fitting-connection concave portion 26. The part existing in the fitting-connection concave portion 26 has the above connecting tab 40 in parallel to the bottom wall 29 of the case 7 and a coupling part 50 which is perpendicular to the connecting tab 40 and in parallel to the side wall 30 of the case 7. On the other hand, the part extending externally of the case 7 is formed as a grounding part 51 having a through-hole for screwing. The grounding part 51 is perpendicularly integrated to the coupling part 50.

The electronic component 8 includes a body 41 having a seat cushion shape as shown and a pair of legs 37, 37. In this embodiment, the electronic component 8 is a known capacitor, but may be a diode or resistor. The electronic component 8 is held in a state not generating rattling owing to vehicle vibration.

Next, on the basis of the configuration described above, an explanation will be given of assembling of the cover-assembled electric wire 4, assembling of the unit body 6 and assembling of the electronic-component incorporating unit 2.

As regards the cover-assembled electric wire 4, first, in the intermediate portion 3 of the electric wire 1 which is a desired position, the cover portion 11 is removed in a prescribed range to expose the conductor 10. The electric-wire side terminal 12 is connected to the conductor 10 thus exposed. Next, if the cover member 5 is attached to the electric wire 1 so as to overlie the portion of the electric-wire side terminal 12, assembling of the cover-assembled electric wire 4 is completed. In this way, the cover-assembled electric wire 4 is previously assembled.

After assembling of the cover-assembled electric wire 4 has been completed, the electric contacts 16, 16 of the electric-wire side terminal 12 are exposed through the notches 21, 21 of the cover member 5. Further, the one secured part 17 of the electric wire side terminal 12 is secured to the securing projection 22 of the cover member 5. At this time, it is positioned. The electric wire side terminal 12 is secured in a state where it is housed in the wire housing portion 19 of the cover member 5. The electric wire side terminal 12 is protected by the cover member 5. The electric wire 1 is supported by the electric wire supporting parts 24, 24 of the cover member 5. Assembling of the cover-assembled electric-wire 4 is completed in the shape keeping the horizontal state of the electric wire 1.

As regards the unit body 6, first, the housing concave cover 28 of the case 7 is opened so as to place the electronic component housing concave portion 25 in an opened state. Next, the relay terminal 38 and grounding terminal 9 are attached to a prescribed position of the fitting-connection concave portion 26. Next, the body 41 of the electronic component 8 is housed in the electronic-component housing concave portion 25, and also with the middles of the legs 37, 37 of the electronic component 8 being inserted into the electronic component leg supporting parts 36, 36, the respective tip sides of the legs 37, 37 are laid on the fixed substrate part 46 of the relay terminal 38 and connecting tab 40 of the grounding terminal 9 in the fitting-connection concave portion 26, thereby making the first connecting portion 15 and the second connecting portion 39. Finally, the housing concave cover 28 is closed to be secured to the opening edge of the electronic component housing concave portion 25 so that the body 41 of the electronic component 8 is held down. Thus, assembling of the unit body 6 is completed.

As regards the electronic-component incorporating unit 2, its assembling will be performed after assembling of the cover-assembled electric wire 4 and assembling of the unit body 6 are completed. Assembling of the electronic-component incorporating unit 2 is completed by fitting the cover-assembled electric wire 4 in the fitting-connection concave portion 26 of the unit body 6 and simultaneously making an electric connecting state therebetween. Since the cover-assembled electric wire 4 is previously formed, the electronic-component incorporating unit 2 can be simply assembled by fitting this cover-assembled electric wire 4 in the fitting-connection concave portion 26 of the unit body 6 by a one-touch operation.

As regards the fitting in the fitting-connection concave portion 26, because of the presence of the case inserting guide area 20, the cover member 5 is smoothly guided into the fitting-connection concave portion 26, thus completing the fitting. Further, the cover-side fitting part 23 of the cover member 5 is secured to a securing part 52 having a through-hole shape formed in the fitting-connection concave portion 26, thereby completing the fitting. Upon completion of the fitting in the fitting-connection concave portion 26, the electric wire 1 is also supported by the electric wire supporting parts 35, 35 of the fitting-connection concave portion 26. Incidentally, FIGS. 7 and 8 show the state where the direction of the cover member 5 is not a normal direction and so the fitting is limited.

As understood from the explanation referring to FIGS. 1 to 8, in accordance with this invention, since the fitting and connection are executed using the cover-assembled electric wire 4, the operability can be improved as compared with the prior art. In addition, the catching of the electric wire 1 and damaging of the electric-wire side terminal 12 can be prevented.

Figure 9A:
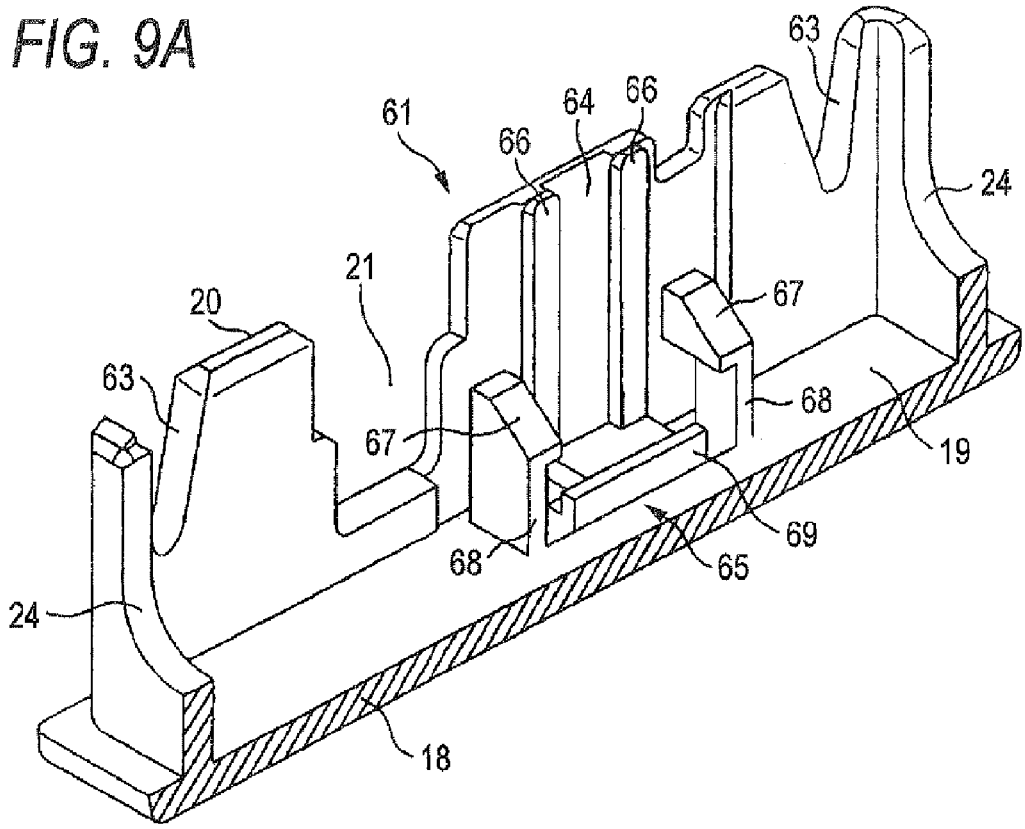
FIG. 9A is a sectional perspective view showing another example of the cover member.
Figure 9B:
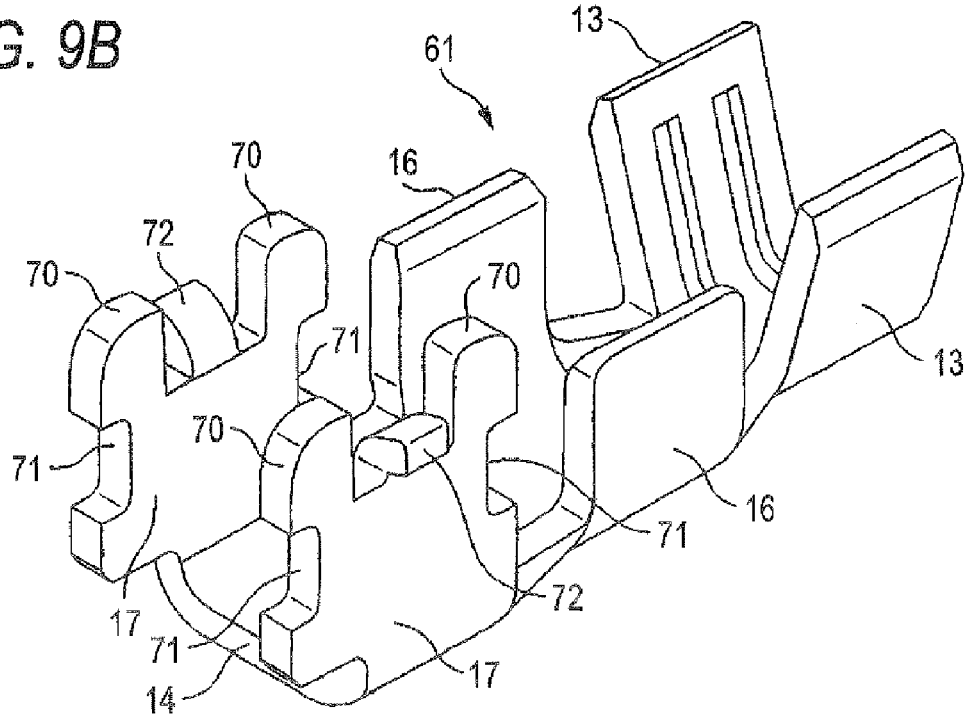
FIG. 9B is a perspective view showing another example of the electric-wire side terminal.
Figure 10:
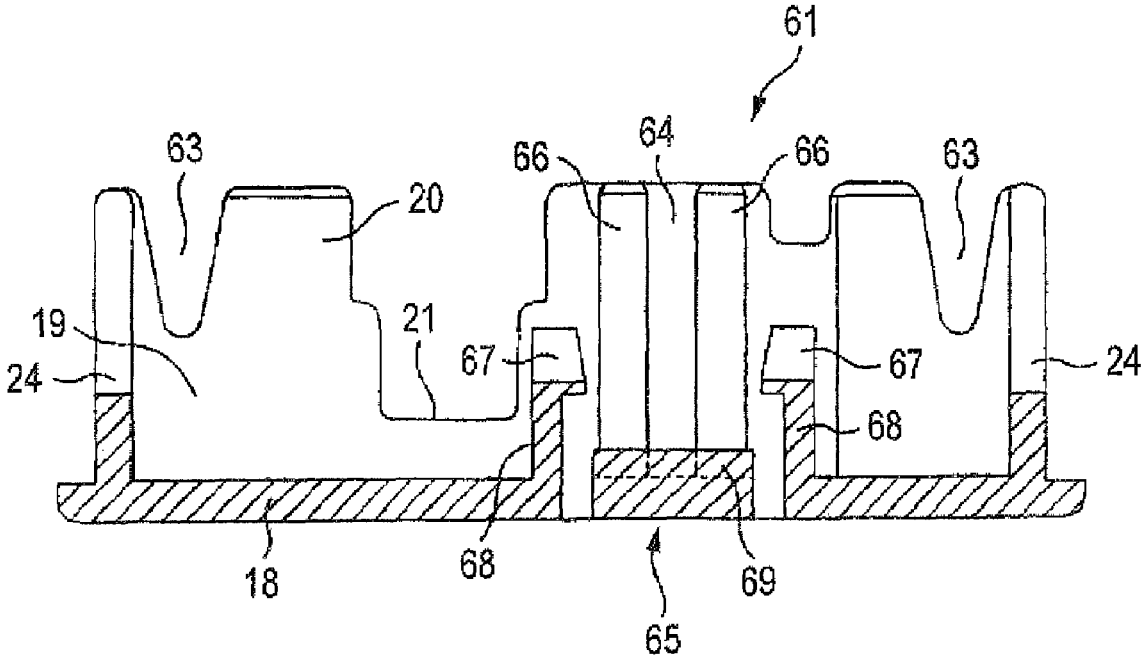
FIG. 10 is a sectional view of the cover member.
Figure 11A:
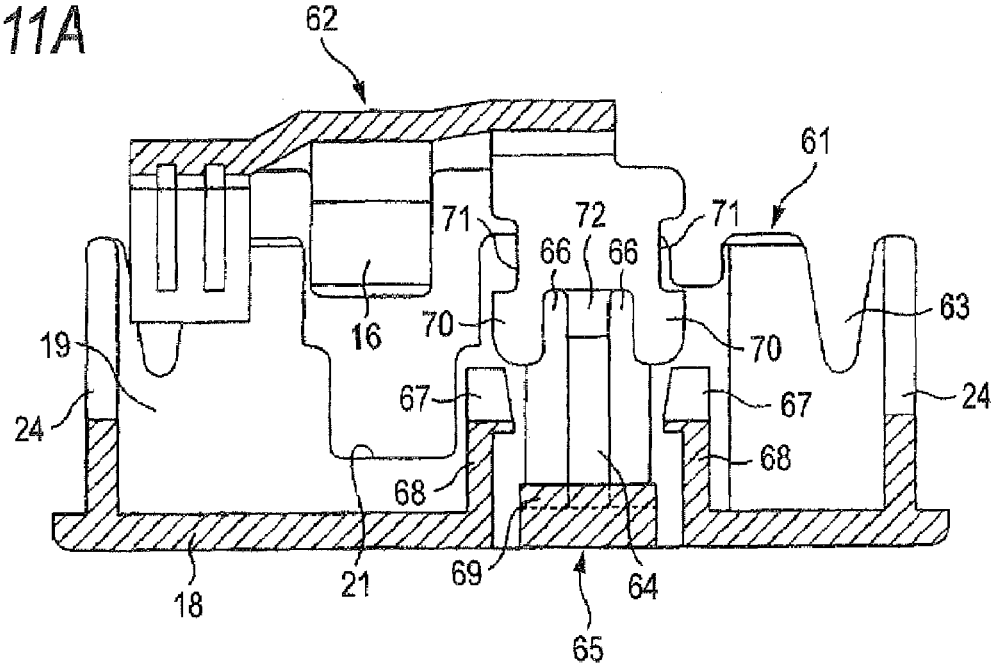
FIG. 11A is a sectional view showing the assembling midpoint state between the cover member and the electric-wire terminal.
Figure 11B:
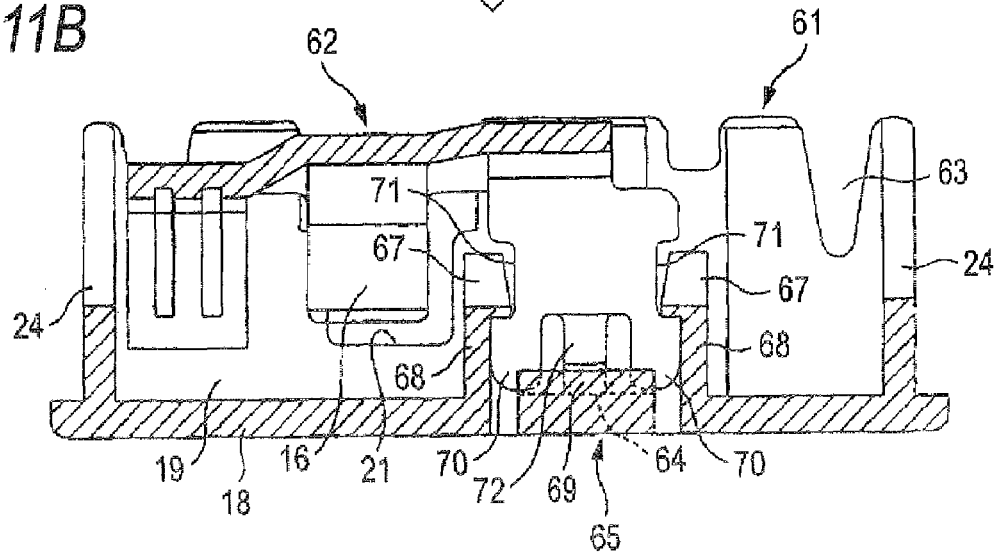
FIG. 11B is a sectional view after the assembling has been completed.
Figure 12:
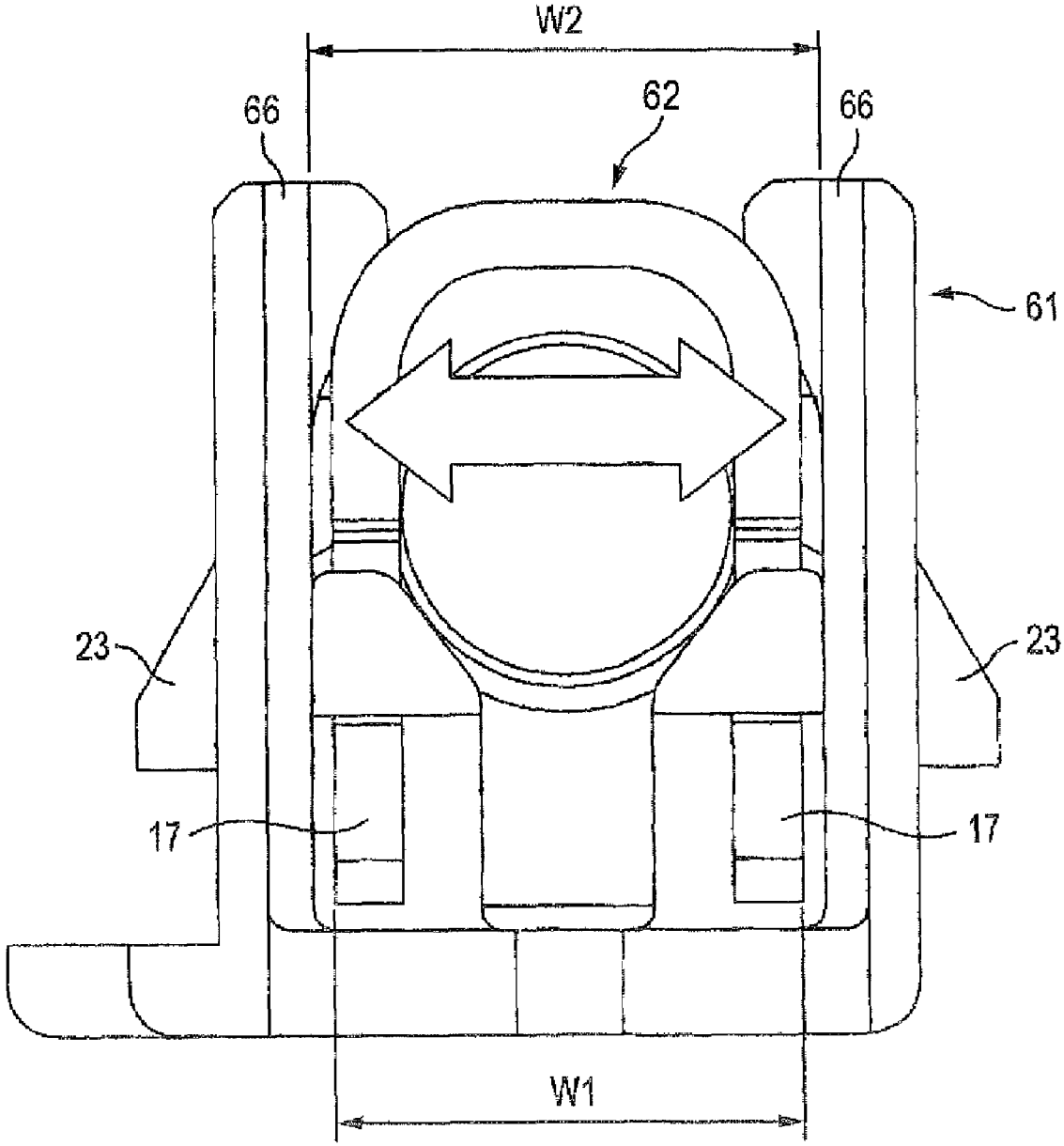
FIG. 12 is an explanation view on alignment.

Next, referring to FIGS. 9A to 12, an explanation will be given of another example of the cover member and the electric-wire side terminal. FIG. 9A is a sectional perspective view showing another example of the cover member. FIG. 9B is a perspective view showing another example of the electric-wire side terminal. FIG. 10 is a sectional view of the cover member. FIG. 11A is a sectional view showing the assembling midpoint state between the cover member and the electric-wire terminal. FIG. 11B is a sectional view after the assembling has been completed. FIG. 12 is an explanation view on alignment. It is assumed that the electric wire 1 and unit body 6 are the same as in the embodiment described above (Their illustration is not given).

In FIGS. 9 and 10, a cover member 61 is a member made of synthetic resin having insulation, and is formed to be held on the electric wire 1 in an area of an electric-wire side terminal 62. The cover member 61 has a roof wall 18 and a side wall formed integrally to the roof wall 18. As regards the side wall, its inside constitutes an electric-wire housing portion 19. The outside of the side wall constitutes a case inserting guide area 20 which is to be inserted into the case 7 for guidance.

Further, the side wall has notches 21, 21 at the positions corresponding to the pair of electric contact parts 16, 16 of the electric-wire side terminal 62. The side wall has also a generally projecting shape cover-side fitting part 23 (see FIG. 12) to be fitted in the case 7, and electric wire supporting parts 24, 24. Reference numeral 63 denotes release parts for the legs 37, 37 of the electronic component 8.

The electric wire housing portion 19 has terminal inserting guide grooves 64, 64 integrated to the inner face of the side wall. In the vicinity of the terminal inserting grooves 64, 64, securing parts 65, 65 are formed, respectively. Incidentally, since FIG. 9A shows the section, only one of the terminal inserting guide grooves 64, 64 and of the securing parts 65, 65 is illustrated.

In this embodiment, the terminal inserting guide groove 64 is formed as a groove between a pair of vertical ribs 66, 66. The terminal inserting guide groove 64 is formed straight toward the roof wall 18 from the end of the side wall. In this embodiment, the securing part 65 includes securing lugs 67, 67, electric-wire axial direction positioning ribs 68, 68 and an auxiliary rib 69. The terminal inserting guide groove 64 and securing part 65 are formed as a portion relative to fixing of the electric wire side terminal 62, and also a portion constituting an alignment mechanism described later.

The electric-wire side terminal 62 is formed in such a shape as shown by working a metallic plate having conductivity. The electric-wire side terminal 62 includes an electric-wire connecting part 13 (which becomes the state as shown in FIG. 1 by swaging) directly connected to the conductor 10, a substrate part 14 continuous to the electric-wire connecting part 13, a pair of electric contacts 16, 16 formed upright integrally to the sides of the substrate part 14 and connected to the first connecting portion 15, and a pair of secured parts 17, 17 likewise formed upright integrally to the sides of the substrate part 14 and secured to the cover member 61.

The electric contacts 16, 16 are tab-like portions and arranged so that they are in parallel on both sides in a direction perpendicular to the electric wire axis of the electric wire 1. The electric contacts 16, 16 are located between the electric wire connecting part 13 and the secured parts 17, 17. Like the pair of electric contacts 16, 16, the secured parts 17, 17 are arranged so that they are in parallel on both sides in the direction perpendicular to the electric wire axis of the electric wire 1. In this embodiment, the secured parts 17, 17 have securing lug catching parts 70, 70, electric-wire axial direction positioning concave parts 71, 71 and insertion guide ribs 72, 72, respectively. Each of the secured parts 17, 17 is formed as a portion relative to fixing, and also a portion constituting the alignment mechanism described later. Each of the secured parts 17, 17 is arranged and formed so as to correspond to the securing part 65 of the cover member 61.

In FIG. 12, the width interval W1 between the secured parts 17, 17 of the electric-wire side terminal 62 is set to be narrower than the width interval W2 between the vertical ribs 66, 66. This setting is made so that the alignment mechanism can function.

In the configuration described above, assembling of the cover member 61 and electric-wire side terminal 62, as shown in FIG. 11, is performed in such a manner that by sliding the inserting guide ribs 72, 72 of the secured parts 17, 17 of the electric-wire side terminal 62 inserted in the terminal inserting guide grooves 64, 64 of the cover member 61, the secured parts 17, 17 are fit/secured to the securing parts 65, 65. After the secured parts 17, 17 are slid in a fashion climbing over the securing lugs 67, 67 of the securing parts 65, 65, they are fixed/secured by the securing lugs 67, 67, electric-wire axial direction positioning ribs 68, 68, auxiliary rib 69; and securing catching parts 70, 70 and electric-wire axial direction positioning concave parts 71, 71. Thus, the electric-wire side terminal 62 is fixed with no backlash in the electric wire axial direction.

Upon completion of the assembling of the cover member 61 and electric-wire side terminal 62, since the width interval W1 between the secured parts 17, 7 is narrower than the width interval W2 between the vertical ribs 66, 66, in a bold arrow direction in FIG. 12, as described above, the backlash in the direction perpendicular to the electric wire direction is positively formed. Within the range of this backlash, alignment during the connection can be made (the function of the alignment mechanism is shown). Specifically, even if the connecting position is slightly deviated from the center position between the spring contacts 47, 47 of the relay terminal 38, the position of the electric-wire side terminal 62 can be aligned by the backlash positively formed in the direction perpendicular to the electric wire axis. Thus, connecting reliability can be improved.

Further, it is needless to say that this invention can be modified within the scope not departing from the spirit of the invention.

What is claimed is:

1. A connecting structure of an electric wire and an electronic-component incorporating unit, comprising:

a unit body including a case having an electronic-component housing concave portion and a fitting-connection concave portion and an electronic component housed in said electronic-component housing concave portion, wherein a first connecting portion extended from the electronic component is provided in said fitting-connection concave portion;

an electric wire having an electric-wire side terminal in a middle of the electric wire in an electric-wire direction; and a cover member having an electric wire housing portion held on said electric wire so as to overlie an area of said electric-wire side terminal and a cover side fitting part to be fitted in said fitting-connection concave portion, wherein said cover member is assembled with said electric wire to form a cover-assembled wire, said cover-assembled wire is fit in said fitting-connection concave portion, and said first connecting portion is connected to said electric-wire side terminal;

wherein said cover member is secured to the electric-wire side terminal of the cover-assembled wire;

wherein said first connecting portion includes spring contacts in elastic contact with said electric wire side terminal.

2. The connecting structure of an electric wire and an electronic-component incorporating unit according to claim 1, wherein an electric wire supporting part is formed at a position of each of both sides in an electric-wire axial direction sandwiching said electric-wire side terminal.

3. The connecting structure of an electric wire and an electronic-component incorporating unit according to claim 1, wherein said cover member has a structure which includes said electric wire housing portion in an inside thereof, a case inserting guide area which is to be inserted into said fitting-connection concave portion for guidance in an outside thereof and said cover side fitting part formed on said case inserting guide area.

4. The connecting structure of an electric wire and an electronic-component incorporating unit according to claim 3, wherein said case inserting guide area and said electric wire housing portion protect said electric-wire side terminal.

5. The connecting structure of an electric wire and an electronic-component incorporating unit according to claim 1, wherein said fitting-connection concave portion or said first connecting portion comprises fitting-limiting parts for limiting fitting of said cover-assembled electric wire into the unit body.

6. The connecting structure of an electric wire and an electronic-component incorporating unit according to claim 1, wherein said electric-wire side terminal includes a first electric contact directly connected to a conductor of the electric wire, a second electric contact adapted to be connected to the first connecting portion, and a secured part that is adapted to be secured to the cover member.

7. The connecting structure of an electric wire and an electronic-component incorporating unit according to claim 6, wherein the cover member further comprises a projection arm that is secured to the secured part.

* * * * *